US006149293A

United States Patent [19]

Pavese

[11] Patent Number: 6,149,293

[45] Date of Patent: Nov. 21, 2000

[54] HIGH EFFICIENCY ULTRACOLLOIDAL EMULSIFYING MODULE FOR BASICALLY IMMISCIBLE FLUIDS AND RELATED METHODS

[76] Inventor: Guy C. Pavese, 5, rue du General de Gaulle, 67520 Kirchheim, France

[21] Appl. No.: 09/180,980

[22] PCT Filed: May 21, 1997

[86] PCT No.: PCT/FR97/00888

§ 371 Date: Nov. 18, 1998

§ 102(e) Date: Nov. 18, 1998

[87] PCT Pub. No.: WO97/44122

PCT Pub. Date: Nov. 27, 1997

[30] Foreign Application Priority Data

May 21, 1996 [FR] France ..... 96 06450

[51] Int. Cl.[7] ..... B01F 3/08; B01F 5/06

[52] U.S. Cl. ..... 366/119; 366/176.2; 366/340

[58] Field of Search ..... 366/117–119, 124, 366/167.1, 173.1, 173.2, 174.1, 175.2, 176.1, 176.2, 336, 340; 138/40, 42, 43

[56] References Cited

U.S. PATENT DOCUMENTS

| | | | |
|---|---|---|---|
| 1,848,100 | 3/1932 | Benner et al. | 366/176.1 |
| 2,198,614 | 4/1940 | Hayes . | |
| 4,218,221 | 8/1980 | Cottell | 366/124 |
| 4,352,573 | 10/1982 | Pandolfe | 366/176.2 |
| 4,514,095 | 4/1985 | Ehrfeld et al. | 366/340 |
| 4,869,849 | 9/1989 | Hirose et al. | 366/340 |
| 5,720,551 | 2/1998 | Shechter | 366/176.1 |

FOREIGN PATENT DOCUMENTS

| | | |
|---|---|---|
| 2461515 | 2/1981 | France . |
| 2731504 | 9/1996 | France . |
| 1678426 | 9/1991 | Russian Federation . |

OTHER PUBLICATIONS

Database WPI, Section Ch. Week 8618, Derwent Publications Ltd., London, GB; Class H08, AN 86–118158 XP002025233 & SU 1184552A (Roof Mydroinsul Mat), Oct. 15, 1985.

Database WPI, Section Ch. Week 9233, Derwent PUblications Ltd., London, GB; Class D14, AN 92–275073 XP002024742 & SU 1678426A (Kiev Tekhenergokimprom Res Proon Assoc); Sep. 23, 1991.

*Primary Examiner*—Charles E. Cooley
*Attorney, Agent, or Firm*—Davis and Bujold

[57] ABSTRACT

The invention features an emulsifying module comprising a cylindrical body (1) with a direct input block (5) or mixing block (4), at one of its ends, and an adjustable output block (3) at its other end. The body (1) contains one or more hollow cylindrical cartridges (8) allowing the mixture to pass through the cartridge from one end to the other. The cartridges (8), linked with one another and with the end blocks of the tubular body (1) via resilient spring linking mechanisms (14 to 18), each contain a plurality of vibrating discs (24) slidingly mounted on a hollow central axle (25). The hollow central axle (25) has a plurality of oscillating discs which cover and uncover lateral outlets provided in the axle to facilitate mixing. This invention is useful for emulsifying numerous liquid or gas products, in particular greasy liquid products, fuels, motor fuels, oils in various applications, heating, energy, compound products, and engines.

13 Claims, 7 Drawing Sheets

HIGH EFFICIENCY ULTRACOLLOIDAL EMULSIFYING MODULE FOR BASICALLY IMMISCIBLE FLUIDS AND RELATED METHODS

The present invention concerns an emulsifying module for producing a mixture or an ultracolloidal emulsion from at least two immiscible fluids, one of which is a primary fluid, specifically, an oily liquid fluid mixed with water and/or various liquid or gaseous additives.

BACKGROUND OF THE INVENTION

There is a demand for thoroughly mixed or ultrafine, stable mixtures in various fields, such as the production of cosmetics, foods, and especially fuels and combustibles.

Numerous emulsifiers or emulsionizers which produce an oil-in water type emulsion are already known. Such an emulsion has a certain degree of fineness and is only minimally stable, enough to satisfy its intended purpose.

Many emulsifiers are merely improved homogenizers capable of producing only a low quality, unstable, coarse emulsion.

However, emulsifiers do exist are which capable of producing an emulsion with adequate characteristics and qualities for a particular purpose.

Movable disc emulsifiers for immiscible liquids are known in the art, as described in Patent Nos. FR 2 461 515 filed Jul. 27, 1979 by Robert Guerin and FR 2 731 504 by Société MEROBEL.

In the first invention of Robert Guerin, the emulsifier is formed by stacking annular units stored in a tube sealed at each end by a coupling piece. These annular pieces can slide along a median longitudinal axis and they are separated from one another by a central lateral tubular extension allowing them to interlock. Each annular element has two types of peripheral notches disposed so that they form baffled passageways between one annular element and the next. The stack forms a block maintained in flexible equilibrium at a distance from the tube extremities by helicoidal springs which simultaneously provide cohesion to the unit. The fluid arrives through the hollow extremities of the median longitudinal axis on which the annular elements are mounted. The liquid mixture travels along the annular space occupied by the annular elements and leaves the tube in an emulsified state. Thus, the entire block is subjected to oscillation caused by the pulsating effects of cavitation.

Since the liquid passes through only the notches in this unit, the emulsifier loses considerable capacity and the emulsifying effect is limited to what can occur during passage through the baffles.

Additionally, the configuration of this device and the stacked arrangement cause the annular elements to become blocked fairly quickly.

Furthermore, it is not possible to produce an ultrafine emulsion, as there is no high frequency fluid shearing.

The main features of the second invention derive from the first invention. The stack consists of a succession of perforated cylindrical plates and interposed layers of passageways with bi-conical tapered portions separated from one another by empty areas, with the unit forming a block fitted within a tubular body. The passageways between successive plates and layers are laterally offset so as to form baffles.

Here again, the baffle structure prevents achieving an ultrafine emulsion. The baffle structure forming a compact stack either will not allow the plates and layers to vibrate at all, or prevents them from vibrating enough to attain the amplitudes required to make the even higher frequencies effective. Such high frequency vibrations combine with the shearing phenomenon to produce an ultrafine emulsion.

Also known in the art is Russian Patent No. SU 1 678 426 filed Oct. 10, 1989 relating to a liquid cavitation emulsifier.

This mixing device consists of masses that are movable along a median longitudinal axis, separated from one another by a spring. These masses are solid and thick. They can only be displaced enough to oscillate at a low speed, thus preventing auto-resonance at a high enough frequency to create an emulsion, and certainly not an ultrafine emulsion such as the emulsion which is the object of the present invention.

The goal of the invention is to produce an ultrafine emulsion from two immiscible liquids while using the smallest amount of energy possible.

With the method of the present invention, it is possible to achieve thoroughly mixed emulsions which extend the limits of stability and finesse, and to attain ultracolloidal quality which is immune from substantial physical modifications over a period of several weeks or even several months, while consuming vastly reduced amounts of energy.

The applications vary depending upon the initial product. This may be a fatty food product, and the invention may produce fatty food emulsions for light cuisine such as margarine or shortening. Or it may consist of fatty emulsions used in the composition of beauty products or lotions.

In the domain of fuels, it is possible to envision a diesel vehicle operating with an emulsion of water and gasoline as a fuel. The use of variable amounts of water over a broad range would maintain essentially the same level of performance. But more importantly, the quality of combustion and reduction in engine emissions and oily byproducts would contribute significantly to pollution control efforts.

The same is true with hydrocarbon fuels such as light fuel oil, heavy fuel oil, and the like.

An ultracolloidal emulsion produces cleaner combustion in heating fuel, which is self-cleaning and economical in terms of energy costs.

SUMMARY OF THE INVENTION

For these reasons, the invention provides a high performance emulsifying module which produces a product with exceptional physical qualities.

The high efficiency emulsifier of the invention for producing highly stable mixtures and/or emulsions from basically immiscible fluids can be used alone or in a group with several other modules in a series, in parallel, or in a different arrangement.

It is characterized by having a tubular body with an input block for admitting fluids under pressure and an output block at its second extremity, with the interior of the tubular body comprising a plurality of hollow cartridges, one front surface of which provides a passageway for the fluid, and which are connected to one another and to the end blocks in each instance by a resilient longitudinal connector, said cartridges being attached in a series and separated from one another by a spring forming a flexible connector between the cartridges and the end blocks of the tube; the cartridges have an open opposing front surface and being fitted to the diameter of the tubular body in a piston-like fashion, with each cartridge surrounding a plurality of vibrating discs which slide along a hollow coaxial axis with a series of outlets extending along it for partially supplying the fluid.

Said discs are alternately covered and uncovered by the oscillation motions which displace the vibrating discs, while the cartridges oscillate according to their own physical properties and those of the flexible longitudinal connectors.

The inlet block is a mixer formed of a central channel with a conical inlet and an outlet diverging towards the interior of the central tubular body into an auxiliary diverging tube, which has a projecting extremity that forms a base for the resilient longitudinal end connector joining the inlet block to the adjacent cartridge; it further comprises two lateral inlets through two transverse conduits with staggered openings leading into the central channel and communicating with the secondary longitudinal conduits opening into the tubular body.

Besides producing a high quality, ultracolloidal emulsion which is very stable and very fine, the invention offers many other advantages, of which only the most important will be cited below:

- the proportions of the two main liquids can be very precisely regulated;
- a very little energy is consumed;
- it is low cost in comparison to the results produced;
- it has numerous applications, particularly agriculture/food, cosmetics, chemistry and petro-chemistry, gas turbines, heating mechanisms, internal combustion engines and many others;
- it can be used to formulate ternary emulsions;

and various other applications which call for a fine emulsion or pressure homogenization.

BRIEF DESCRIPTION OF THE DRAWING(S)

Other features and advantages of the invention will be apparent from the following description, given by way of example, accompanied by the drawings, in which.

DESCRIPTION OF THE PREFERRED EMBODIMENT(S)

Figure 1:
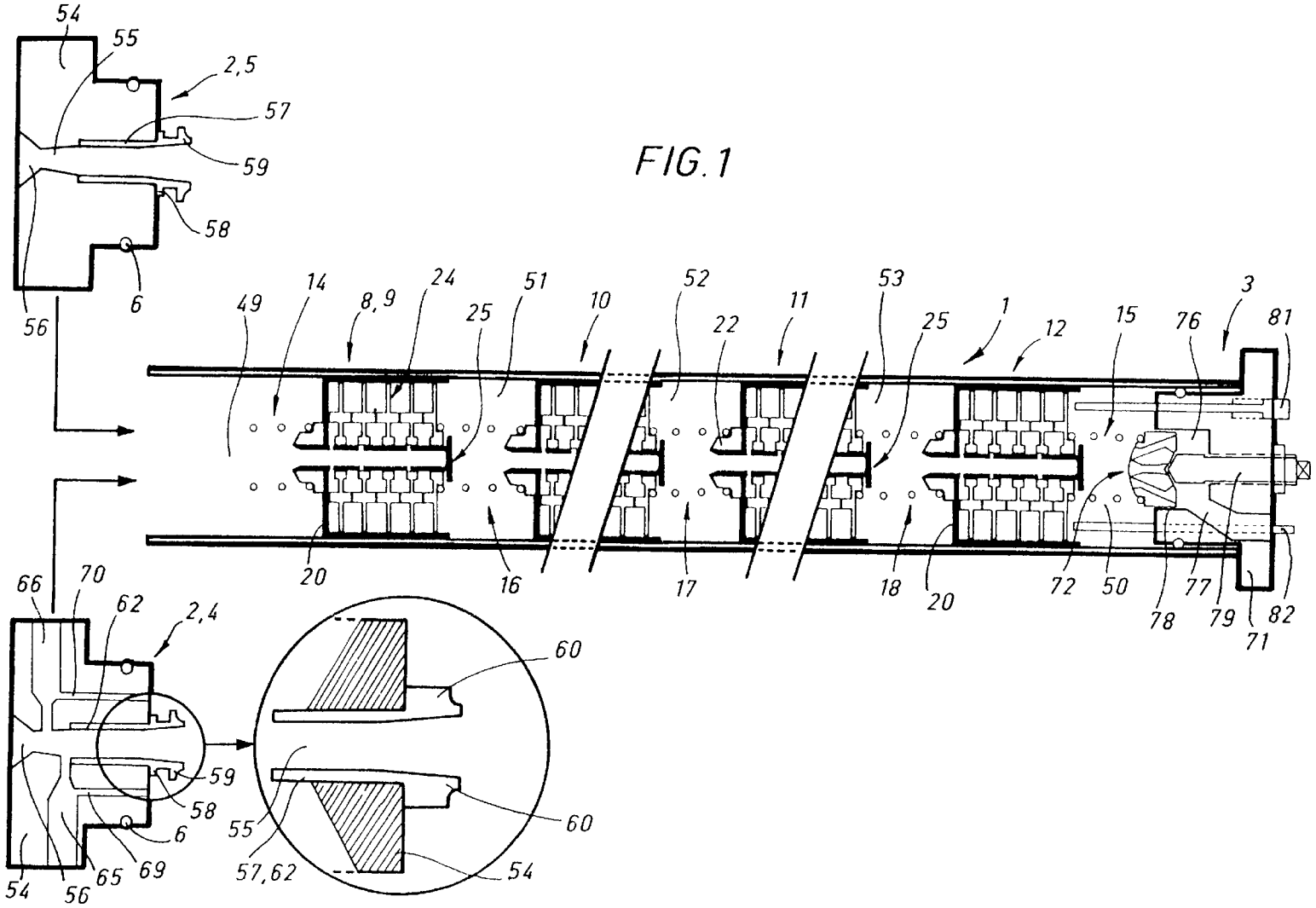
FIG. 1 is a longitudinal cross-section of the basic emulsifying module according to the invention showing the two variations of the inlet block.

The present invention is based on the principles of turbulence, cavitation, shearing, and laminar flow applied to liquids known to be immiscible at low and medium pressure, and the means of obtaining a high quality mixture or emulsion with superior fineness and stability.

For the sake of simplicity, from this point on, all modules or groups of modules encompassed by the invention will be referred to as emulsifying modules, that is, mixing modules, homogenizers, pre-emulsifiers, emulsifiers, and homogenizer-emulsifiers.

The module or group of modules according to the invention can serve as a homogenizer for particularly unstable liquids or fluids, or both.

As the first drawings show, there are several variations of homogenizers or emulsifiers or homogenizer-emulsifiers, all referred to below as emulsifiers, which can be grouped to form a complex multi-stage emulsifier that could also include a pump.

First, there is a base module which may serve as either a pre-emulsifier or an emulsifier.

It is formed of a cylindrical tubular body 1 sealed at either end by an end block, which may be either an inlet block 2 or an outlet block 3, for the passage of one or more fluids or a mixture of fluids. Inlet block 2 may consist of either a three-track mixing inlet block 4, or a single track inlet block 5. The supply circuits for the different tracks include a pump (not shown) for carrying the fluid or mixture of pressurized fluids to the module.

Mixing block 4 is equipped with two tracks for fluids to be emulsified, for example (but not necessarily), water and a vector fluid such as an oily fuel, a vegetable, animal, or other liquid, said third track being provided for an additional liquid such as a reactive, a by-product, a colorant, or the like. Pressurized fluid arrives at the inlets.

Each end block 2 or 3 is attached to cylindrical body 1, for example, it may be joined with a gasket seal such as seals 6 and 7, respectively.

Cylindrical tubular body 1 houses at least one oscillating cartridge such as cartridge 8 or several oscillating cartridges, for example, four cartridges, such as those denoted by numerals 9, 10, 11, 12 (FIG. 1); this number may vary depending upon the base module. The oscillating cartridges are hollow cylindrical bodies 13 fitted inside the cylindrical body like a piston, allowing them to slide easily. Oscillating cartridges 8 are interconnected and also joined to the inlet and outlet end blocks with resilient connectors, for example, end springs 14 and 15 and intermediate springs 16, 17, 18, called counter-reaction springs, actually forming multiple longitudinal, axial suspension systems in which the cartridges are masses that begin to oscillate as the fluid or mixture of pressurized fluids passes through.

The body of each cartridge opens at one transverse extremity on a rear front surface 19, while the body of each cartridge is closed at the other transverse extremity by a front wall 20 allowing fluid to pass; for example, it may be solid but perforated with openings such as outlets 21, and the surface of the opposing rear face forms the base of the cartridge. The outlets 21 for the passage of fluid in this front wall 20 may be distributed in a regular radial, circular pattern. Front wall 20 comprises an enlarged cylindrical area 22 which may project from the surface for hydrodynamic purposes, in the central area, serving as a seating for one of the springs which form the resilient connection. Cylindrical enlargement 22 has drilled openings 23.

The space inside each cartridge is occupied by a series of vibrating discs such as disc 24, attached to slide with minimal play, one after the other, along a hollow, interior, coaxial median axis (axle) 25, the first end of which is closed and has a transverse terminal shoulder stop 26, and a second open, threaded extremity 27 of smaller diameter, defining a shoulder-stop 28. Threaded extremity 27 engages drill hole 23 formed in the center of projecting cylindrical enlargement 22 on the solid front wall 20 of the cartridge. Vibrating discs 24 occupy the entire transverse section of the cartridge, and there is only a small amount of play with the interior cylindrical wall of the cartridge, so the discs slide freely within the cartridge, requiring very little force to overcome friction, and without blocking. The discs occupy almost the entire length of hollow central coaxial axis 25, with the result that there is only a very slight amount play between them, just slight mutual transverse axial displacements.

Hollow axis 25 has calibrated transverse openings such as opening 29, which may be semi-circular or triangular. These openings may only be present on the anterior half of its length. During axial displacement caused by oscillation, they are alternately uncovered and covered by the central opening in each vibrating disc attaching them to the hollow axle. These openings are divided into groups 30, 31, 32 arranged in one transverse circular line. It is considered sufficient to provide four openings arranged at 90° angles on each section. Openings 29 in the first group 30 are immediately proximate to shoulder-stop 28 on threaded extremity 27 of hollow axis 25. Successive openings are separated by a distance equal to the width of one disc, then equal to the width of two discs. Naturally, the arrangement shown in this execution merely shows one non-limiting example.

When inactive, that is, when there is no liquid flow and no pressure in the cartridge, discs 24 are pressed against each other by the action of the rear spring opposite the spring which contacts full frontal wall 20. Said rear spring contacts the central portion of the last disc, which serves as a base for the spring. The force of the spring pushes the unit of discs 24 against the base the of cartridge which is the rear surface of frontal wall 20.

Note that there is one end base disc 33, that is, a closed disc. This disc is maintained in contact with the rear surface of frontal wall 20 by pressure from the adjacent spring. Note also that there is a rear end disc 34, that is, an open disc, which serves as a contact surface for the adjacent spring, as it includes cylindrical projection 35 on the central portion.

Next the formation and characteristics of vibrating discs 24 will be examined. These are presently made of non-corroding metal, but they could also be made of plastic material or a composite alloy with suitable mechanical qualities, sufficiently resistant to wear and friction. The same is true for the cartridge bodies.

Several types of discs are distinguished. First, there are the end discs: base disc 33 in contact with the base wall, and rear disc 34, and next the intermediate discs such as discs 36 and 37, of two types.

As the drawings show, the intermediate discs differ in that they may or may not have a perforated central portion. There are solid intermediate discs 36 and perforated discs 37. They have the following general characteristics:

Each intermediate disc has a central opening such as opening 38 with approximately the same diameter as the exterior diameter of hollow axis 25 so that it can be guided to slide freely along the axis, for example, loosely fitted on it. Each central opening 38 is defined on each surface by a full rim 39 and 40. The discs also have on the central portion of each surface a circular projection 41 and 42 concentric with the full rim, with two axial crenelated notches such as notches 43. Notches 43 on said crenelated projections 41, 42 are angularly spaced apart from each other in a regular pattern and angularly spaced apart from a projection on the opposing surface.

A single disc may incorporate a crenelated projection 41 or 42 on one side and a corresponding smooth, full projection (not shown) on the opposite side.

Each crenelated projection 41 or 42 defines with each corresponding full rim 39 or 40 on central opening 38 a full area 44 or a perforated annular area 45, with perforations 46 in a regular, crown-ike arrangement, serving as axial passageways. The presence or absence of these perforations forms the main distinction between intermediate discs 36 and 37. In order to distinguish between them, the terms solid intermediate discs 36 and perforated intermediate discs 37 will be used. The solid discs and the perforated discs both have a plurality of peripheral notches on their periphery 47, varying in number, and defined by notches such as notch 48 of varying depths and widths. The notches on solid intermediate discs 36 are more numerous than the notches on perforated intermediate discs 37.

Figure 12:
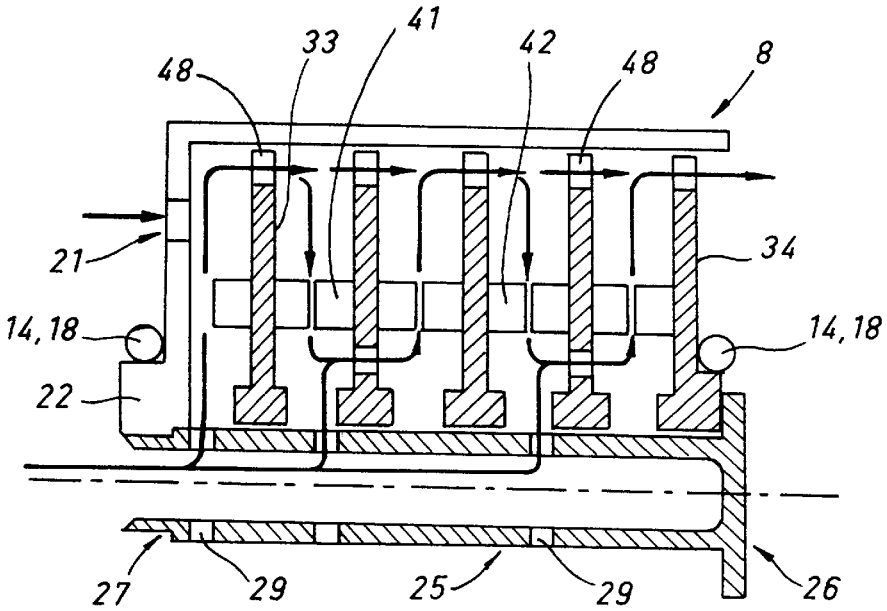
Figure 13:
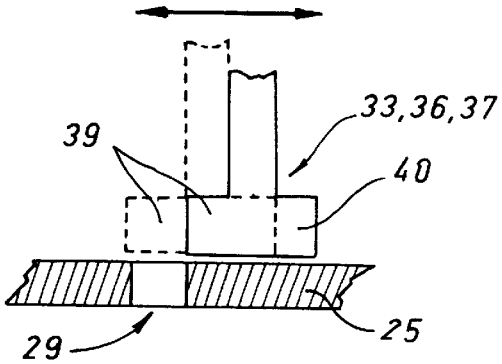
FIG. 13 is a schematic view showing the movement of the central portion of a disc in front of an aperture in the hollow axis.

According to a variation shown in FIGS. 12 and 13, the openings define peripheral notches and the axial openings 43 on crenelated projections 41, 42 are diagonally disposed in relation to the general longitudinal line of the axis.

The two end discs 33 and 34 are solid discs. Closed end disc or base disc 33 is similar to a solid intermediate disc. Open end disc or rear disc 34 has the same general shape as the solid intermediate discs, but there are more peripheral notches and the crenelated projection on the side facing the spring is replaced by cylindrical projection 35 forming a base for the spring.

Solid intermediate discs 36 and perforated discs 37 alternate. Since two solid discs are required on the ends, there must be an odd number of discs.

By way of example, five discs are shown in FIGS. 1 through 4 and 11, 12. This number constitutes an acceptable compromise for an application with an oily liquid of average fluidity.

Figure 2:
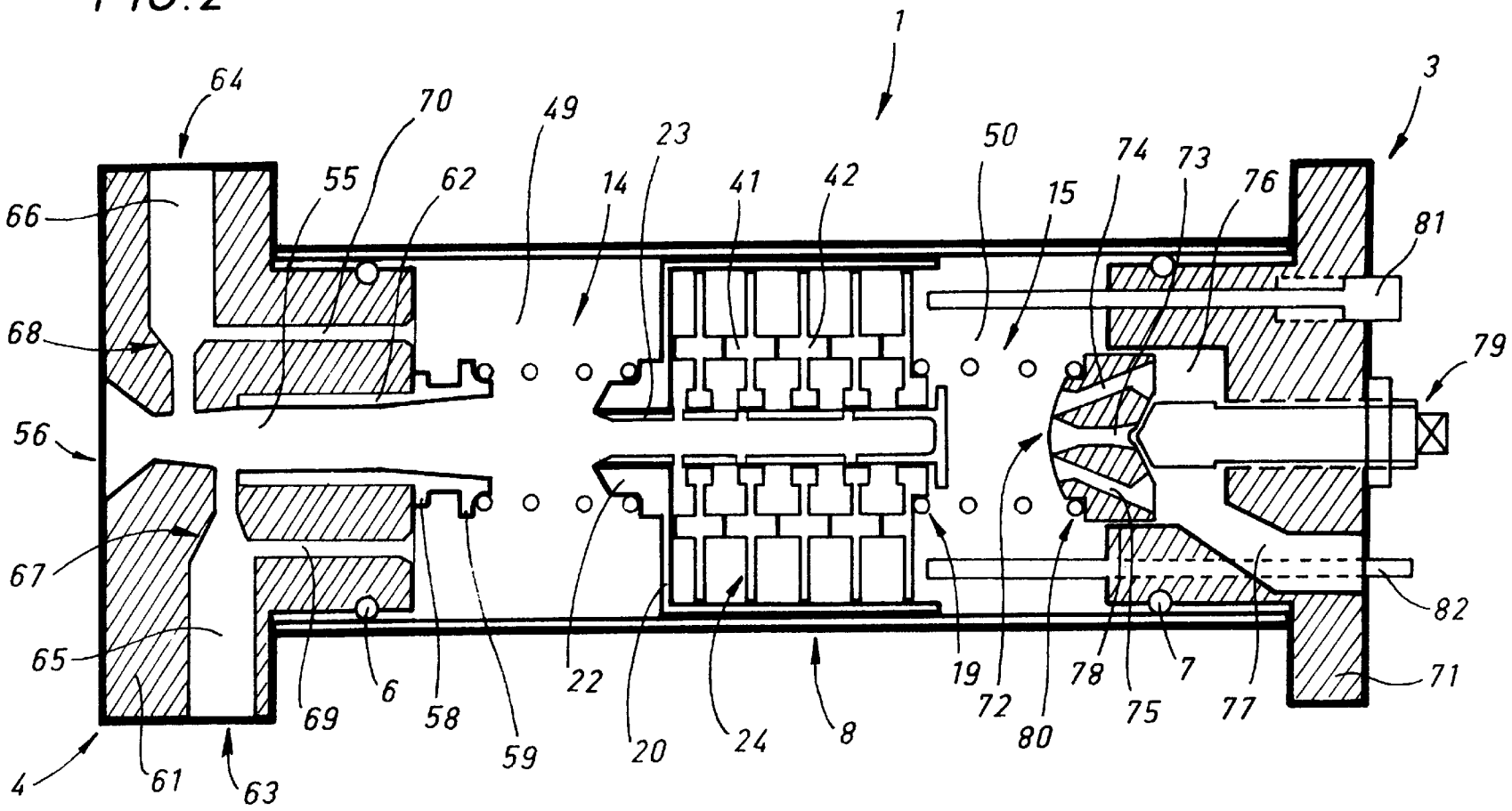
FIG. 2 is a longitudinal cross-section of a variation that is useful as a pre-emulsifier.
Figure 3:
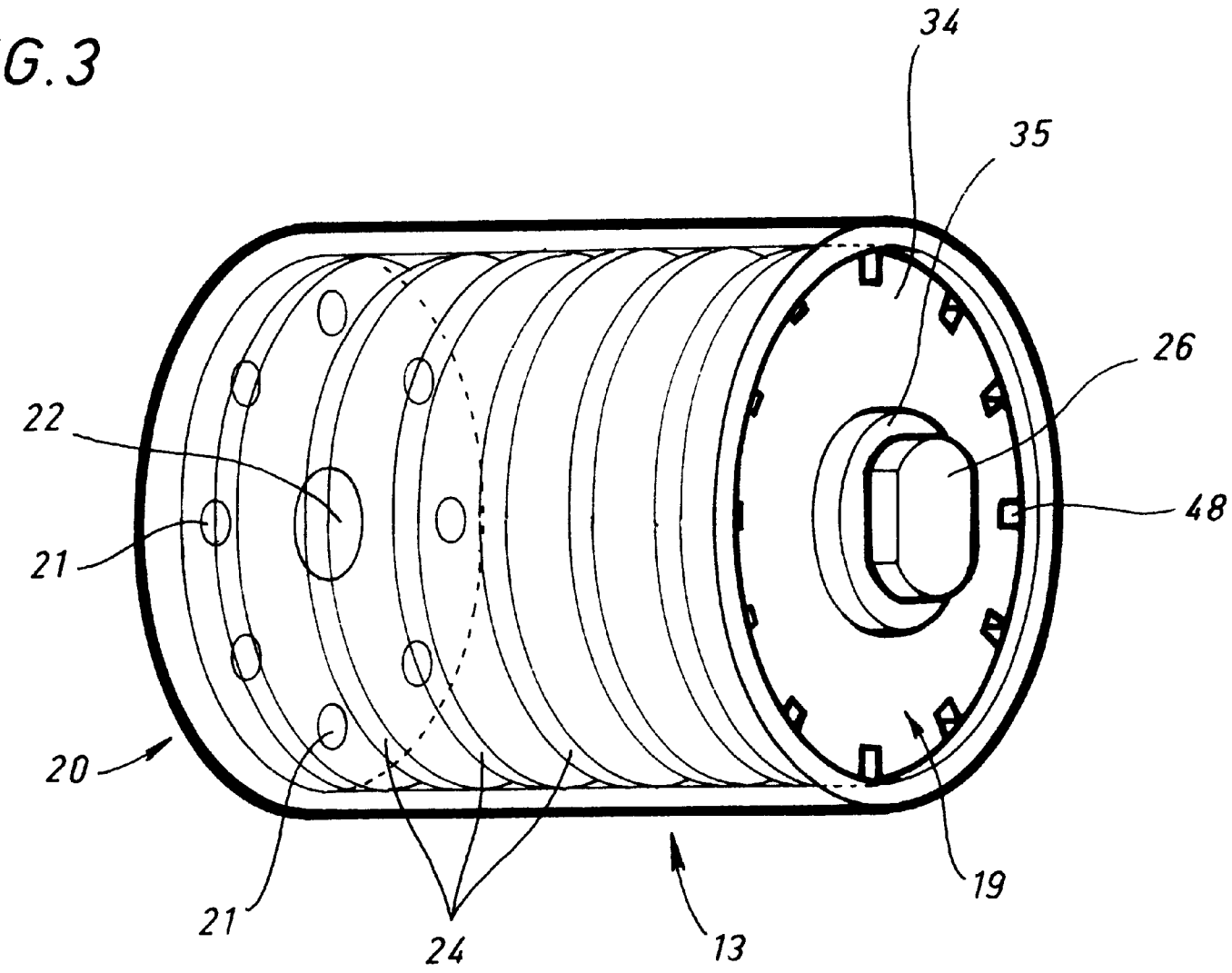
FIG. 3 is a perspective of an oscillating cartridge.
Figure 4:
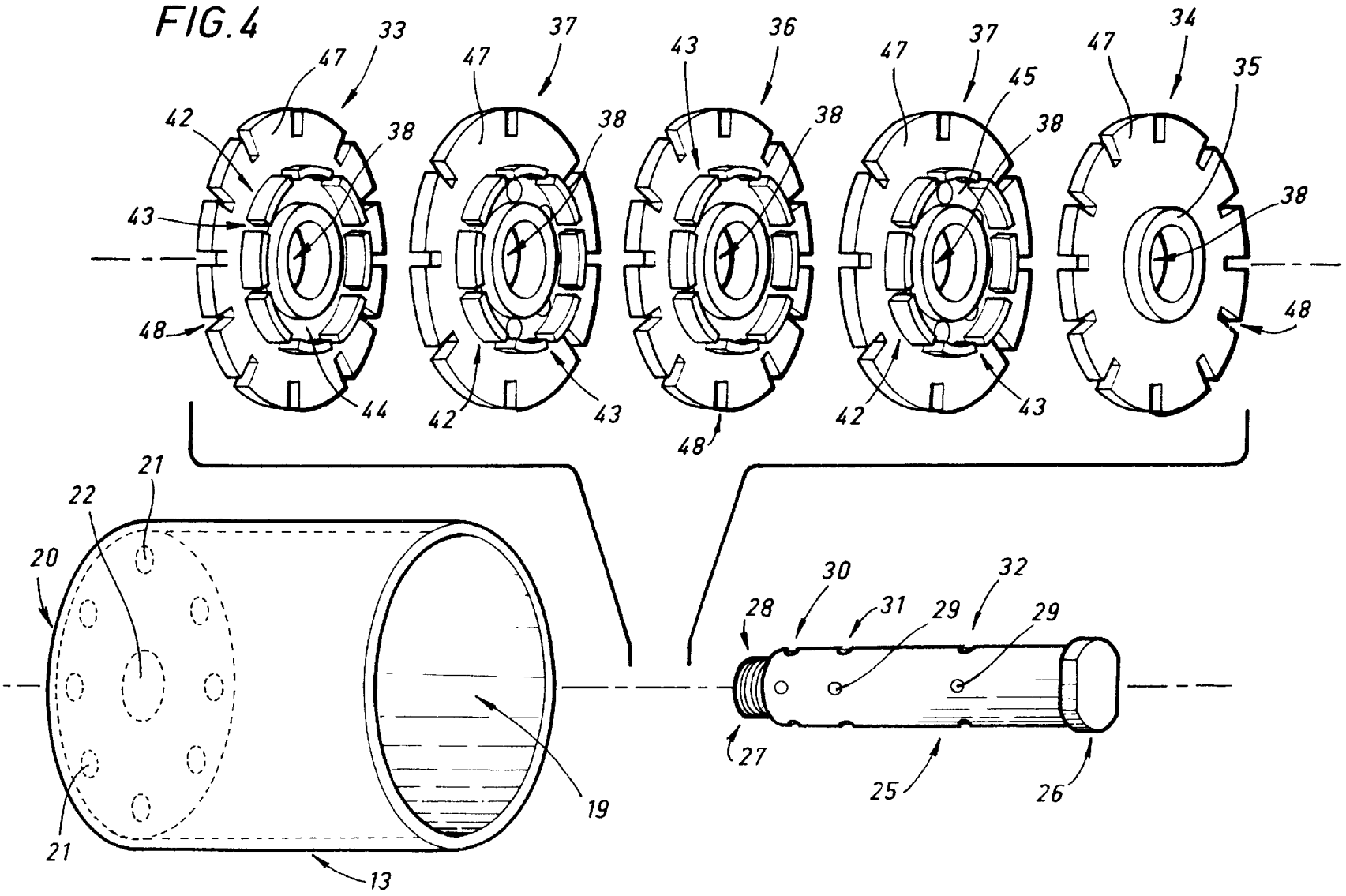
FIG. 4 is an exploded perspective of the oscillating cartridge and its contents.
Figure 5:
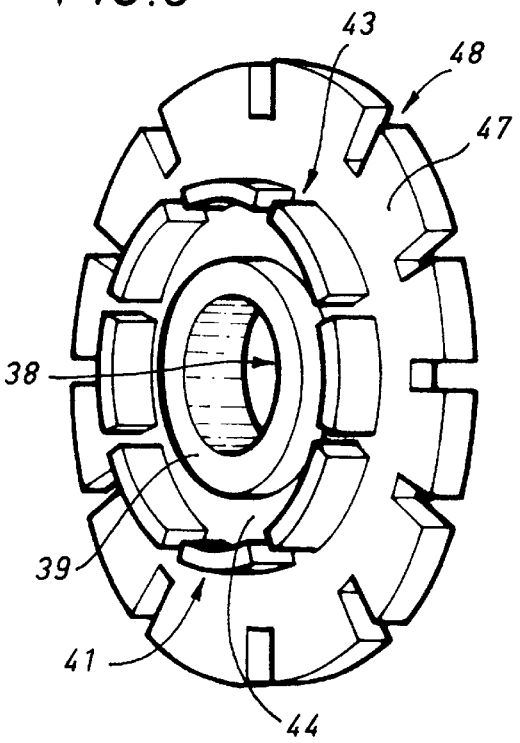
FIGS. 5 and 6 are two perspectives, each showing one surface of a non-perforated disc.
Figure 6:
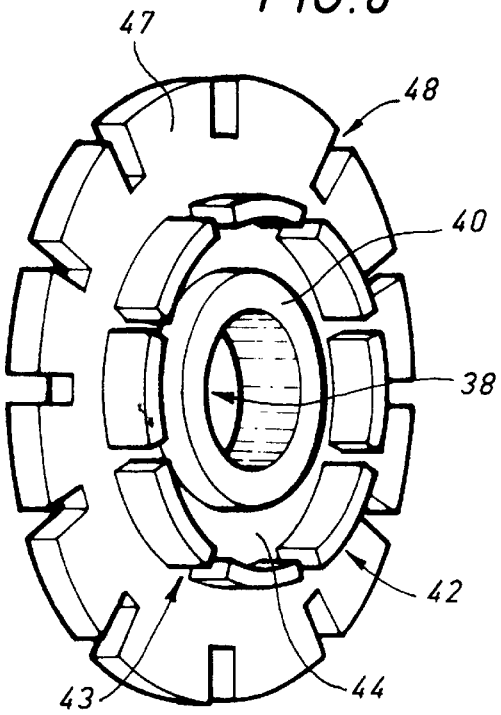
Figure 7:
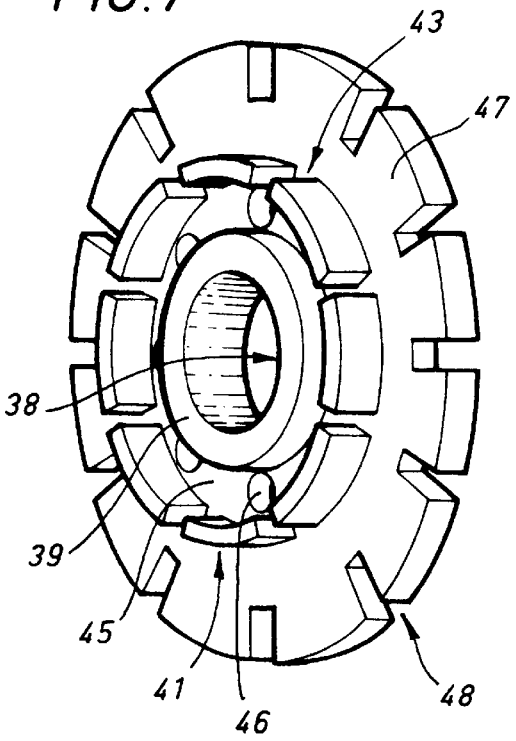
FIGS. 7 and 8 are two perspectives each showing one surface of a perforated disc.
Figure 8:
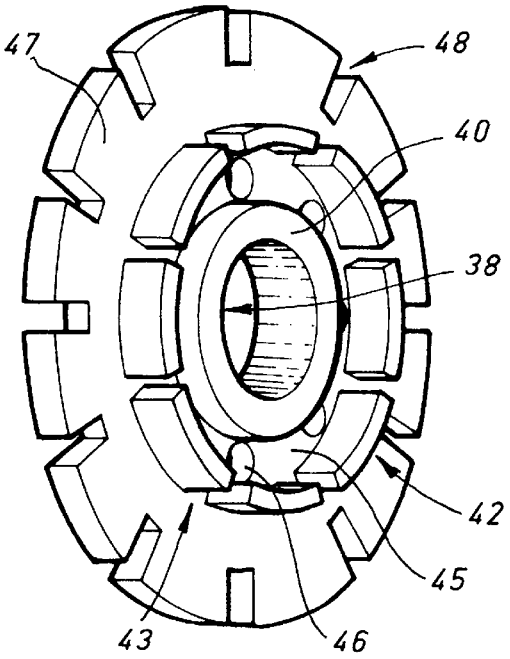
Figure 10:
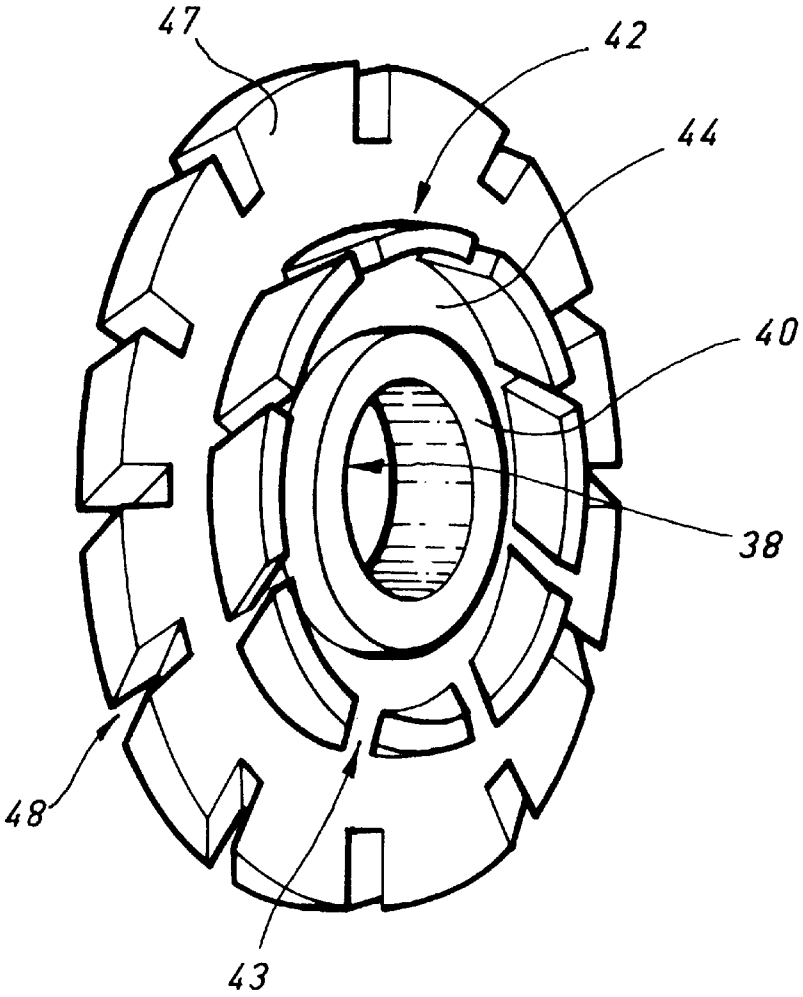
FIGS. 9 and 10 are perspectives of variations of discs having diagonal notches.
Figure 9:
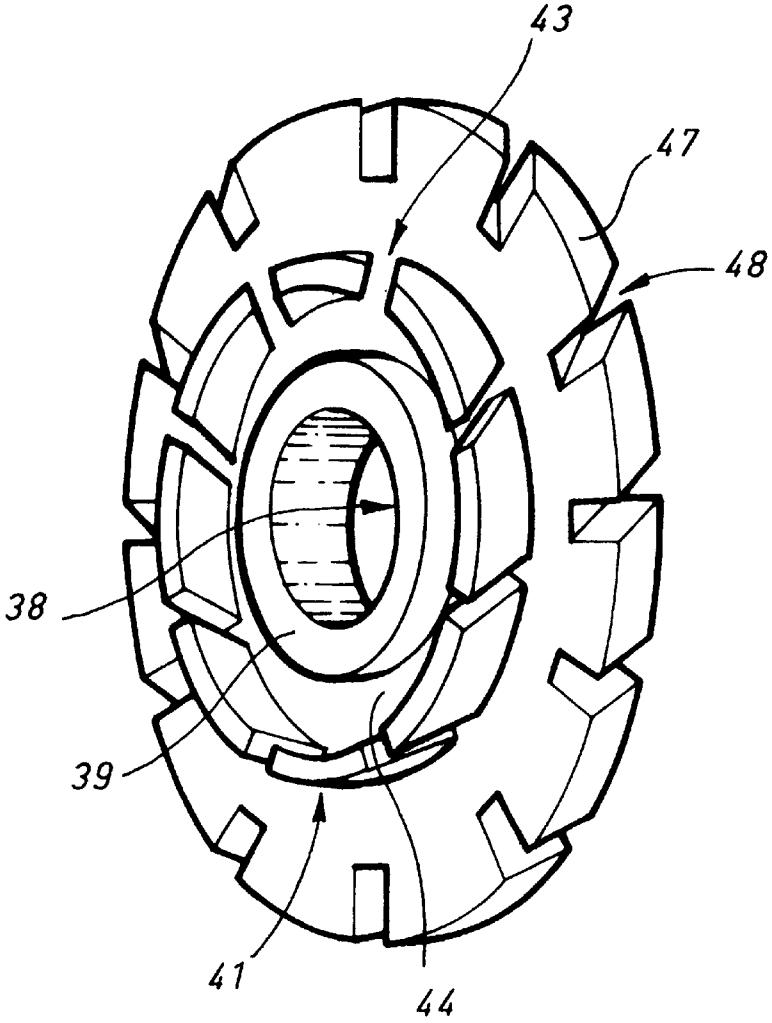

The interior space of the tubular body is occupied by a succession of springs and cartridges, the minimum being one cartridge and two springs, as shown in FIG. 2.

Each end space defined by an end block 2 or 3 and the adjacent cartridge constitutes a passage and turbulence chamber for the fluid or fluid mixture. Thus, after single inlet block 5 or mixing block 4, there are a first turbulence chamber 49, and at the other extremity of the tubular body, a final turbulence chamber 50. The spaces between cartridges enclosing the connecting springs form the intermediate turbulence chambers such as chambers 51, 52, 53.

Next, the input blocks and the output block are described in detail.

Depending upon the application, the input block may be a simple block 5 or a mixing type block 4.

Simple input block 5 takes the form of a stopper element 54 screwed into the threaded extremity of body 1 with a toric seal 6 interposed. Stopper 54 has a central passageway 55 with a conical end opening 56, which passageway includes a tube 57 diverging towards the interior of tubular body 1 and extending from the exterior of the stopper on the side of turbulence chamber 49 into a double shoulder stop, one stop 58 being recessed within the stopper, followed by an end stop 59 forming a base for the end of the spring. The stops may constitute one technical element 60 (see circled portion of FIG. 1).

The end block described as forming the mixer 4 is a separate piece 61. It has approximately the same central input channel 55 with a conical inlet 56 and a diverging tube 62 as the preceding arrangement, and conical extremity 56 of the inlet in line. Two additional transverse inlets 63 and 64 open perpendicularly into central channel 55 near conical extremity 56, but are slightly longitudinally offset to avoid interactions and problems at the outlet. These transverse input annexes 63 and 64 are cylindrical interior passageways 65, 66 which taper at the end into a conical transition 67, 68. A secondary longitudinal conduit 69, 70 crosses the stopper transversely between each conical transition 67, 68 and the adjacent turbulence chamber 49 into which central channel 55 opens. Mixing takes place partially due to the venturi effect inside central channel 55 and partially within the adjacent turbulence chamber 49 through secondary longitudinal conduits 69, 70.

The principal pressurized fluid passes through central channel 55, that is, the fluid with the most rapid flow rate originating from a supply circuit with a pump (not shown). Through the adjacent channels pressure from pumps (not shown) preferably injects the fluids to be mixed or the emulsifying liquid, for example, water, liquid by-products and others in variable quantities depending upon the application, typically between 10 and 20%, but occasionally more or a great deal more. In the case of a specific installation or a process occurring in stages, central channel 55 may receive fluid that is already emulsified.

The simple inlet block emulsifier module having a channel with a diverging pipe or a tube with a diverging interior conduit 57 that extends into a projecting stop 58, 59 serving as a spring base has several vibrating cartridges, the last of which is connected to output block 3 by means of the last resilient longitudinal connector 15.

Output block 3 in the form of stopper element 71 fulfills several functions. The first is evacuation through a central output head 72 forming a collector with several output channels, one of which is central channel 73, and two oblique channels 74, 75 opening into a collection chamber 76 through a diagonal outlet 77. In order to regulate it, outlet head 72 can be moved axially along a longitudinal guide 78 using a punch screw 79. Furthermore, the recessed rim 80 of output head 72 forms a base for the final counter spring 15. When it moves, the head exerts a greater or lesser degree of static compression on the final spring and consequently, all the springs in the tubular body react.

The output block also fulfills two other functions.

The first is to act as a vibration detector using a vibration sensor 81 to provide information to a circuit regarding the level and state of vibrations inside the tubular body so the position of the output head can be adjusted to regulate it and adapt to various vibration requirements.

The second is to act as an adjustable safety stop in the form of a sliding shaft 82 which can be blocked in a predetermined position, or some other means. The tip of this shaft maintains the end disc 34 of the last cartridge at a distance from the end of sensor 81.

The emulsifier module and its variations according to the invention may be used separately or in groups, in series, in parallel, or they may be otherwise grouped or separated by a pump to form one or more stages.

Figure 11:
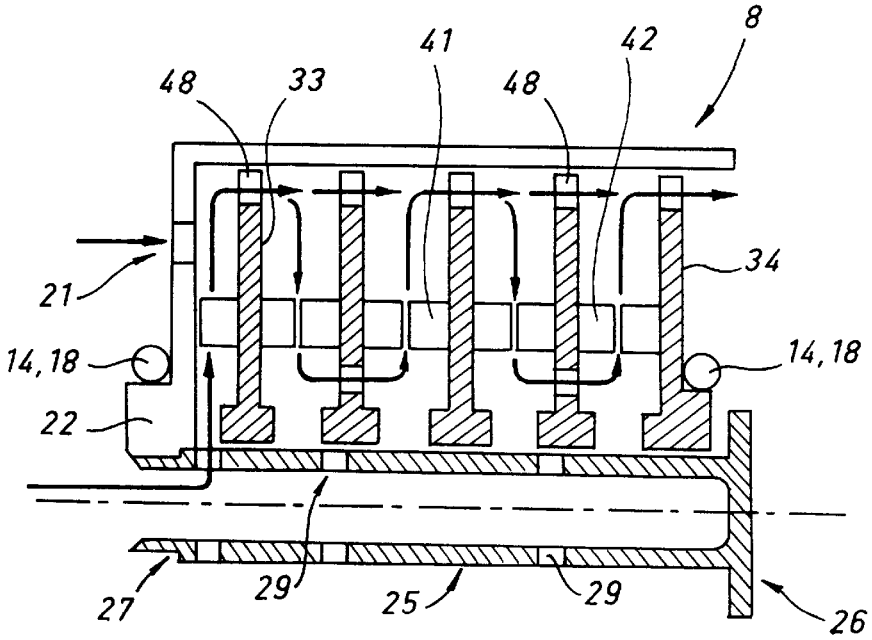
FIGS. 11 and 12 are schematic longitudinal partial cross-sections of a cartridge showing its operation in the inactive and active stages, respectively.

The operation of the module according to the invention will now explained more specifically, with reference to FIGS. 11 through 13.

Base disc 33 in contact with the cartridge base is positioned so that its central opening completely releases outlets 29 of the first group 30 on hollow axle 25 when base disc 33 is in contact with the base wall of the cartridge, thus keeping the outlets of the first group open, regardless of the movements of base disc 33.

When inactive, all the vibrating discs 24 are in contact with one another due to the elastic action of the connecting springs. The positions of the openings 29 in the next groups 31, 32 on hollow axis 25 and the thickness of discs 24 at their central openings are such that at least two discs are displaced above the openings.

At rest, the discs located above outlets 29 on hollow axis 25 cover the openings completely, except for the base disc, as shown in FIG. 11. During operation, the openings are alternately uncovered and covered (FIG. 13), as they oscillate at a higher frequency than the frequency at which the cartridges oscillate.

Several pathways are open to the fluid passing through the cartridge. There are two main paths. The fluid may pass first through frontal wall 20 in each cartridge and through perforations 21, and then through the interior of hollow axis 25. Once inside the cartridge, having passed through frontal wall 20 via openings 21, it applies pressure to base disc 33, which is solid, but has peripheral notches 47 in openings 48, allowing a portion of the liquid to pass through. This pressure will cause displacement when it encounters the push of the counter spring. This force will provoke a slight displacement of the base disc and then the entire unit of discs, as shown by the arrows in FIG. 11.

This displacement causes the other outlets 29 on hollow axis 25 to disengage and open (FIG. 12). These supplemental fluid pathways, shown by the arrows, lower pressure at the cartridge inlet and create a weaker displacement force which, once it becomes weaker than the recall force of the spring, will cause inverse disc displacement, that is, the discs will return to the bottom. When this occurs, intermediate discs 36, 37 will again cover openings 29, thus causing pressure to mount again until it exceeds the recall force of the connecting spring and reverts to the preceding situation. These movements are repeated periodically. The vibrating discs oscillate alternately along hollow axis 25.

Fluid leaving the openings on the hollow central axis, as well as the alternating movements of the central disc openings above the orifices, causes vibrations which are transmitted to the discs and a shearing-laminar flow effect which greatly improves the fineness of the emulsion. This phenomenon begins at the point where pressure values are low, at the level of several bars, and increases until pressure reaches a level ranging from 10 to 100 bars. There is a rate of operation which causes composite vibrations, one component of which corresponds to the vibration frequency of the discs. This rate depends not only upon the mechanical properties of the discs, but also upon the properties of the fluid, such as viscosity, pressure, and flow rate. Obviously, this the ideal situation, as it produces maximum output.

This disc vibration corresponds to a third frequency of operation, the first being the oscillating movement of the cartridges and the second, the alternative movements of the discs along hollow axis 25.

The combination of these three vibratory phenomena, the vibration of fluid flowing along the cartridges and of the tubular body, together with the shearing-laminar flow effect, contribute to the high performance levels and increased output of the emulsifier, as well as the superior quality of the resulting emulsion.

Cartridges 8 slide freely within the tubular body in the same way a piston slides inside a cylinder. The resilient longitudinal extending and retracting counter springs cause each cartridge to oscillate around a position of rest under the influence of incident pressure.

Each cartridge is animated to move alternately at another frequency, lower than that of the discs, which is determined principally by various factors such as flow rate, pressure, and fluid viscosity, as well as the mass of each cartridge and the rigidity of the springs.

The cartridge or cartridges are pushed by the pressure of incident flow, causing a force greater than the push of the recall spring below it, and displacing the cartridge after the spring has compressed. In reaction, the spring develops a recall force causing an opposite movement when pressure on the cartridge decreases due to the larger opening in the inside fluid passageway.

Openings 29 in hollow axis 25 are alternately opened and closed by the movement on the hollow axis of the wall defined by central opening 38 on the adjacent discs (FIG. 13).

These movements alternately uncover and cover the exit openings for the pressurized fluid, creating a shearing-laminar flow effect on the pressurized fluid.

This high frequency shearing-laminar flow effect greatly improves the fineness and stability of the emulsion.

The basic principles outlined above apply to each module. There is a pre-emulsifying module formed of a multi-track mixing input block 4, a turbulence chamber 49, one or more cartridges joined by resilient longitudinal connectors, and an output block 3 with a stop 82 and a vibration sensor 81.

A fluid speed ranging from 5 to 10 m/s at the level of the disc notches and the openings of hollow axis 25 produces an ultrafine emulsion.

Insofar as efficiency is concerned, it has been demonstrated that supplying a high power heating unit of 10,000 kw with emulsified fuel requires an installation of only 2 kw for the emulsifier and a power ratio of 0.2%.

Experiments have shown that fuel consumption is reduced from 10% to 20% for an emulsion titrated with 15 to 20% water. Experiments have also shown that combustion remains possible with up to 50% water.

Engine fuel economy should parallel these percentages.

The invention also relates to a homogenization and emulsion method using the means described above.

The method consists of mixing a pressurized vector fluid with one or more secondary fluids in a multi-track input block, preferably with a central channel and using the venturi effect, and to homogenize the mixture in a first turbulence chamber located at a first extremity of a tubular homogenization-emulsion body blocked at the first extremity by the input block.

The method then involves proceeding to a water-in-oil type emulsion by passing the fluids through one or more cartridges, each containing vibrating discs, said cartridges being connected to one another and to both extremities of the tubular body with resilient connectors, and the unit being essentially similar to that described above.

Finally, the method consists of causing the fluid to pass into a final turbulence chamber sealed by the output block, and regulating the position of the output head supporting the end of the last resilient connecting spring until it reaches the resonance area of the vibrating or oscillating elements contained in the tubular body, with adjustments being made according to information about vibrations inside the tubular body provided by the measurement probe or the vibration sensor.

The method also applies to the use of several models grouped in a series, in parallel, or some other arrangement, with the possible addition of a pump between two successive modules or between two groups of modules.

What is claimed is:

1. A high efficiency emulsifying module for producing one of a stable mixture and a stable emulsion, the emulsifying module comprising a tubular body (1) having opposed open first and second ends, the first end of the tubular body (1) being closed by an input block (2) having a passageway for supplying at least one pressurized fluid to be mixed and the second end of the tubular body (1) being closed by an output block (3) for evacuation of an emulsified fluid via an exit passageway, and an interior of said tubular body (1) containing a plurality of movable elements which are slidably attached to at least one central axle; the emulsifying module comprises:

at least one cartridge (8) for passage of the fluid to be mixed therethrough, and each at least one cartridge (8) having:

at least one hollow central axle with a plurality of lateral outlets (29) provided along an exterior surface thereof, the hollow central axle is opened at an end thereof facing the first end of the tubular body (1) and is closed at an end thereof facing the second end of the tubular body (1), and the lateral outlets (29) form a flow path for conveying the fluid to be mixed through the at least one cartridge;

a cartridge body attached adjacent the open end of the hollow central axle, the cartridge body supports a plurality of vibrating discs confined to slide along an exterior surface of the hollow central axle and a lateral inwardly facing wall of the cartridge body, and the cartridge body is translationally displaceable within the interior of the tubular body (1);

the vibrating discs of the cartridge body are slidable axially along the exterior surface of the hollow central axle between first and second positions, in the first position radially inwardly facing bases of some of the vibrating discs cover at least some of the lateral outlets of the hollow central axle to prevent flow of the fluid to be mixed therethrough while other of the lateral outlets remain uncovered to facilitate flow of the fluid to be mixed therethrough, and in the second position the bases of some of the vibrating discs, that in the first position were axially spaced from the lateral outlets so as to facilitate flow of the fluid to be mixed therethrough, cover some of the lateral outlets which were initially uncovered to prevent flow of the fluid to be mixed therethrough while the bases of some of the vibrating discs, that in the first position covered some of the lateral outlets, are moved axially to uncover at least some of the lateral outlets and facilitate flow of the fluid to be mixed therethrough;

a plurality of resilient connectors (14–18) for resiliently sandwiching each of the at least one cartridge, contained within the interior of the emulsifying module, between inwardly facing surfaces of the input block (2) and the output block (3); and the at least one cartridge has first and second separate supply paths, the first path is provided on a front surface of the cartridge body and the second path is through the open end of the hollow central axle which distributes the fluid to be mixed inside the at least one cartridge through the lateral outlets (29) which are covered and uncovered by an oscillating movement of the vibrating discs (24), along the hollow central axle, caused by the passage of the fluid to be mixed through the emulsifying module, and the oscillation movement of the at least one cartridge (8) is controlled by physical characteristics of the at least one cartridge and the resilient connectors (14–18).

2. The emulsifying module according to claim 1, wherein the input block (2) is a mixer input block (4) with a conical inlet (56) communicating with a central channel (55) for supplying one fluid to be mixed, the central channel (55) communicates with a diverging tube (62) diverging toward the interior of the tubular body (1), the diverging tube (62) has a projecting extremity which forms a base for engaging with one of the plurality of resilient connectors (14–18) connecting the input block with an adjacent cartridge, and the mixer input block (4) has two lateral inlets (63, 64) which supply additional fluid to be mixed to the central channel (55) via two transverse conduits, and each of the two lateral inlets (63, 64) also communicates with the tubular body (1) via a respective secondary longitudinal conduit (69, 70).

3. The emulsifying module according to claim 1, wherein that the input block (2) has only a central channel (55) for supplying one fluid to be mixed, the input block (2) further comprises an additional tube (57) which diverges toward the interior of the tubular body (1), said additional tube (57) has an extremity which projects inside the tubular body and forms a base for engaging with one of the plurality of resilient connectors (14–18) connecting the input block with an adjacent cartridge, and a turbulence chamber (49) is defined between the input block (2) and the adjacent cartridge.

4. The emulsifying module according to claim 1, wherein said output block (3) has a stopper element (71) which engages with the second end of the tubular body, said output block (3) supports an outlet head (72) that is axially movable along a central guide (78) via a screw (79), said outlet head (72) has a central channel (73) and at least two oblique outlet channels (74,75) which all communicate with a collection chamber (76), said outlet head has an exterior rim (80) which serves as a base for a last one of the plurality of resilient connectors (15), the stopper element (71) forms a sensor (81) which measures vibrations of the plurality of resilient connectors (14–18) for regulation purposes, and a safety stop (82) of the stopper element (71) maintains an adjacent disc of the emulsifying module at a desired operating distance from the sensor.

5. The emulsifying module according to claim 1, wherein each cartridge body has a closed front wall (20) which faces the first end of the tubular body (1) and is opened at an opposite end facing the second end of the tubular body (1), the closed front wall (20) has a central opening (22) and a plurality of perforations formed therein, an interior of the cartridge body accommodates the vibrating discs (24) which are slidably attached to the hollow central axle (25), the hollow central axle (25) has a threaded end (27) which engages with a mating thread of the central opening (22) of the cartridge body to secure the vibrating discs (24) to the cartridge, and the closed end of the hollow central axle (25) terminates at a shoulder stop (26).

6. The emulsifying module according to claim 5, wherein a rearward most disc (34) of each cartridge facing the second end of the tubular body (1) is free of perforations and has a projection (35), on a central portion thereof facing the second end of the tubular body (1), which serves as a base for coupling one of the plurality of resilient connectors (14–18) to one of an adjacent cartridge and said output block (3).

7. The emulsifying module according to claim 1, wherein the vibrating discs (24) have a central opening (38) defined by a central rim (39,40) by which the vibrating discs (24) are slidably mounted on the hollow central axle (25), peripheral notches (47) are defined by openings (48) formed in a periphery of the vibrating discs (24), and each of said vibrating discs (24) has a crenelated, cylindrical projection (41, 42) located on an at least one surface thereof with the crenelated, cylindrical projection (41, 42) between the rim (39,40) and the peripheral notches (47).

8. The emulsifying module according to claim 7, wherein at least some of the vibrating discs (37) have a succession of perforations (46) extending through the vibrating discs (37), and the succession of perforations (46) are located between the central rim (39,40) and the crenelated, cylindrical projection (41, 42).

9. The emulsifying module according to claim 1, wherein the emulsifying module comprises a plurality of emulsifying modules which are sequentially coupled with one another.

10. The emulsifying module according to claim 1, wherein the emulsifying module comprises a plurality of emulsifying modules which are sequentially coupled with one another and also coupled with at least one pump.

11. A method for homogenizing and emulsifying at least one main fluid and at least one secondary fluid in a high efficiency emulsifying module comprising a tubular body (1) having opposed open first and second ends, the first end of the tubular body (1) being closed by an input block (2) having a passageway for supplying at least one pressurized fluid to be mixed and the second end of the tubular body (1) being closed by an output block (3) for evacuation of an emulsified fluid via an exit passageway, and an interior of said tubular body (1) containing a plurality of movable elements which are slidably attached to at least one central axle; the method comprising the steps of:

providing at least one cartridge (8) for passage of the fluid to be mixed therethrough, and forming each at least one cartridge (8) with:

at least one hollow central axle with a plurality of lateral outlets (29) provided along an exterior surface thereof, the hollow central axle is opened at an end thereof facing the first end of the tubular body (1) and is closed at an end thereof facing the second end of the tubular body (1), and the lateral outlets (29) form a flow path for conveying the fluid to be mixed through the at least one cartridge;

attaching a cartridge body adjacent the open end of the hollow central axle, the cartridge body supports a plurality of vibrating discs confined to slide along an exterior surface of the hollow central axle and a lateral inwardly facing wall of the cartridge body, and translationally displacing the cartridge body within the interior of the tubular body (1);

sliding the vibrating discs of the cartridge body axially along the exterior surface of the hollow central axle between first and second positions, in the first position a radially inwardly facing bases of some of the vibrating discs cover at least some of the lateral outlets of the hollow central axle to prevent flow of the fluid to be mixed therethrough while other of the lateral outlets remain uncovered to facilitate flow of the fluid to be mixed therethrough, and in the second position the bases of some of the vibrating discs, that in the first position were axially spaced from the lateral outlets so as to facilitate flow of the fluid to be mixed therethrough, cover some of the lateral outlets which were initially uncovered to prevent flow of the fluid to be mixed therethrough while the bases of some of the vibrating discs, that in the first position covered some of the lateral outlets, are moved axially to uncover at least some of the lateral outlets and facilitate flow of the fluid to be mixed therethrough;

resiliently sandwiching, via a plurality of resilient connectors (14–18), each of the at least one cartridge, contained within the interior of the emulsifying module, between inwardly facing surfaces of the input block (2) and the output block (3); and providing the at least one cartridge with first and second separate supply paths, the first path is provided on a front surface of the cartridge body and the second path is through the open end of the hollow central axle which distributes the fluid to be mixed inside the at least one cartridge through the lateral outlets (29) which are covered and uncovered by an oscillating movement of the vibrating discs (24), along the hollow central axle, caused by the passage of the fluid to be mixed through the emulsifying module, and the oscillation movement of the at least one cartridge (8) is controlled by physical characteristics of the at least one cartridge and the resilient connectors (14–18).

12. The method according to claim 11, further comprising the step of sequentially coupling a plurality of emulsifying modules with one another.

13. The method according to claim 12, further comprising the step of coupling at least one pump to the sequentially coupled plurality of emulsifying modules.

* * * * *